US009837709B2

(12) United States Patent
Stepanenko et al.

(10) Patent No.: US 9,837,709 B2
(45) Date of Patent: Dec. 5, 2017

(54) BROADBAND HELICAL ANTENNA WITH CUTOFF PATTERN

(71) Applicant: LIMITED LIABILITY COMPANY "TOP-CON POSITIONING SYSTEMS", Moscow (RU)

(72) Inventors: Anton Pavlovich Stepanenko, Moscow (RU); Andrey Vitalievich Astakhov, Moscow (RU); Dmitry Vitalievich Tatarnikov, Moscow (RU); Ivan Miroslavovich Chernetskiy, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 141 days.

(21) Appl. No.: 14/890,610

(22) PCT Filed: Apr. 9, 2015

(86) PCT No.: PCT/RU2015/000234
§ 371 (c)(1),
(2) Date: Nov. 12, 2015

(87) PCT Pub. No.: WO2016/163909
PCT Pub. Date: Oct. 13, 2016

(65) Prior Publication Data

US 2017/0187103 A1 Jun. 29, 2017

(51) Int. Cl.
*H01Q 1/36* (2006.01)
*H01Q 11/08* (2006.01)
(Continued)

(52) U.S. Cl.
CPC ..... *H01Q 1/36* (2013.01); *H01Q 9/12* (2013.01); *H01Q 9/27* (2013.01); *H01Q 11/08* (2013.01); *H01Q 21/24* (2013.01); *H01Q 25/001* (2013.01)

(58) Field of Classification Search
None
See application file for complete search history.

(56) References Cited

U.S. PATENT DOCUMENTS 4,148,030 A * 4/1979 Foldes ..... H01Q 1/362 343/895
4,161,737 A * 7/1979 Albright ..... H01Q 1/362 343/749
4,163,981 A * 8/1979 Wilson ..... H01Q 1/085 343/715

(Continued)

FOREIGN PATENT DOCUMENTS

| | | |
|---|---|---|
| EP | 1833116 | 9/2007 |
| RU | 2208272 | 7/2003 |
| RU | 2395877 | 7/2010 |

OTHER PUBLICATIONS

Bankov, Sergei et al., Raschet kvadrifilyarnoi atenny. Sovremennaya elekmtronika, No. 1, 2008.
Search Report in PCT/RU2015/000234, dated Feb. 4, 2016.

*Primary Examiner* — Trinh Dinh
(74) *Attorney, Agent, or Firm* — Bardmesser Law Group

(57) ABSTRACT

A broadband quadruple helical circularly-polarized antenna for receiving GNSS signals comprises an excitation circuit and a set of quadruple spiral elements. Each quadruple spiral element consists of four conductors. Each conductor is a one spiral turn of the quadruple spiral element. Said conductors have equal winding angle. The winding angle of all conductors does not change in the same quadruple spiral element. Conductors of neighboring (longitudinally) quadruple spiral elements have different winding angles. The antenna provides a sharp drop in AP at angles near the horizon and a small AP level in the lower hemisphere.

11 Claims, 12 Drawing Sheets

(51) Int. Cl.

| | |
|---|---|
| ***H01Q 21/24*** | (2006.01) |
| ***H01Q 9/27*** | (2006.01) |
| ***H01Q 25/00*** | (2006.01) |
| ***H01Q 9/12*** | (2006.01) |

(56) References Cited

U.S. PATENT DOCUMENTS

| | | | | |
|---|---|---|---|---|
| 4,169,267 | A * | 9/1979 | Wong | H01Q 11/083 343/749 |
| 6,172,655 | B1 * | 1/2001 | Volman | H01Q 1/36 343/895 |
| 6,229,498 | B1 * | 5/2001 | Matsuyoshi | H01Q 1/362 343/850 |
| 6,246,379 | B1 * | 6/2001 | Josypenko | H01Q 1/36 343/850 |
| 6,288,686 | B1 * | 9/2001 | Josypenko | H01Q 11/08 343/895 |
| 6,300,917 | B1 * | 10/2001 | Leisten | H01Q 1/36 343/702 |
| 6,344,834 | B1 | 2/2002 | Josypenko | |
| 6,407,720 | B1 * | 6/2002 | Josypenko | H01Q 11/08 343/895 |
| 6,587,081 | B2 * | 7/2003 | Noro | H01Q 1/362 343/853 |
| 6,836,257 | B2 * | 12/2004 | Louvigne | H01Q 11/08 343/895 |
| 7,015,873 | B1 * | 3/2006 | Talley | H01Q 1/002 343/727 |
| 2003/0016184 | A1 * | 1/2003 | Kitching | H01Q 1/362 343/895 |
| 2017/0187103 | A1 * | 6/2017 | Stepanenko | H01Q 1/36 |

* cited by examiner

| Embodiment | Section# | Winding angle, deg | Length, mm | Diameter, mm |
|---|---|---|---|---|
| FIG. 3A | 311 | 42 | 85 | 24 |
| | 312 | 28 | 15 | |
| | 313 | 59 | 107 | |
| | 314 | 31 | 15 | |
| | 315 | 48 | 92 | |
| | 316 | 73 | 15 | |
| | 317 | 62 | 78 | |
| FIG. 3B | 321 | 26 | 63 | |
| | 322 | 59 | 14 | |
| | 323 | 50 | 150 | |
| | 324 | 54 | 14 | |
| | 325 | 45 | 86 | |
| | 326 | 62 | 14 | |
| | 327 | 61 | 115 | |
| | 328 | 15 | 14 | |
| | 329 | 42 | 64 | |
| FIG. 3C | 331 | 25 | 64 | |
| | 332 | 49 | 15 | |
| | 333 | 54 | 73 | |
| | 334 | 32 | 15 | |
| | 335 | 48 | 80 | |
| | 336 | 31 | 15 | |
| | 337 | 68 | 129 | |
| | 338 | 17 | 15 | |
| | 339 | 49 | 130 | |
| | 340 | 19 | 15 | |
| | 341 | 21 | 50 | |

FIG. 4

BROADBAND HELICAL ANTENNA WITH CUTOFF PATTERN

BACKGROUND OF THE INVENTION

Global navigation satellite systems (GNSS) are widely used for high-precision positioning, such as the US Global Positioning System (GPS) and Russian global navigation system GLONASS, as well as some others. A GNSS antenna has to provide signal reception in the whole GNSS range, namely, a low-frequency band 1164-1300 MHz and high-frequency band 1525-1610 MHz.

One of the most important positioning errors in GNSS systems is a so-called multipath error, when a signal reflected from the underlying ground surface appears at the input of the receiving antenna along with the line-of-sight signal.

The value of the multipath error is proportional to the ratio $$DU(\theta) = \frac{F(-\theta)}{F(\theta)}$$

This ratio is normally called the Down/Up ratio. In this ratio, θ is the elevation angle over the horizon, and F(+/−θ) is the antenna pattern (AP) at angle θ above and under the local horizon (θ=0°) correspondingly. A spatial region where θ>0 is the upper or front hemisphere, otherwise, a spatial region at θ<0 is called the lower or backward hemisphere.

To provide a stable and reliable operation of positioning systems, quality signal reception from all satellites over the local horizon is required. The value F(θ) in the upper hemisphere is not to highly vary. At the same time, the value F(θ) in the lower hemisphere should be as small as possible. So the value F(θ) should have a sharp drop in the vicinity of the local horizon (i.e., near θ=0°).

Receiving antennas thus need to provide such an AP whose level is negligibly varied in the upper hemisphere, sharply drops in crossing the direction to the local horizon, and is small in the lower hemisphere. Also, such an antenna pattern needs to be provided over whole operational frequency range.

SUMMARY OF THE INVENTION

The objective of the invention is an antenna with an antenna pattern whose level varies slightly in the upper hemisphere, drops in the direction of the local horizon, and is small in the lower hemisphere, over the entire desired frequency range.

To implement this objective, a circularly-polarized antenna is utilized in the backfire operation mode, the antenna comprising a set of elements each representing a quadruple cylindrical spiral. The spiral winding angle for neighboring elements is different. An excitation circuit is arranged above the antenna.

In another embodiment, an antenna for receiving circularly polarized signals includes a hollow dielectric cylinder (used as mechanical support for the conductors) oriented along a vertical axis; four spiral conducting elements wrapped around the cylinder; the four spiral conducting elements are divided into a plurality of longitudinal sections. The conducting elements in each section have a constant winding angle around the cylinder. The winding angle of all of the conducting elements in the same longitudinal section is the same. Neighboring longitudinal sections have different winding angles relative to each other. An excitation circuit is connected to the conducting elements.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

Figure 3A:
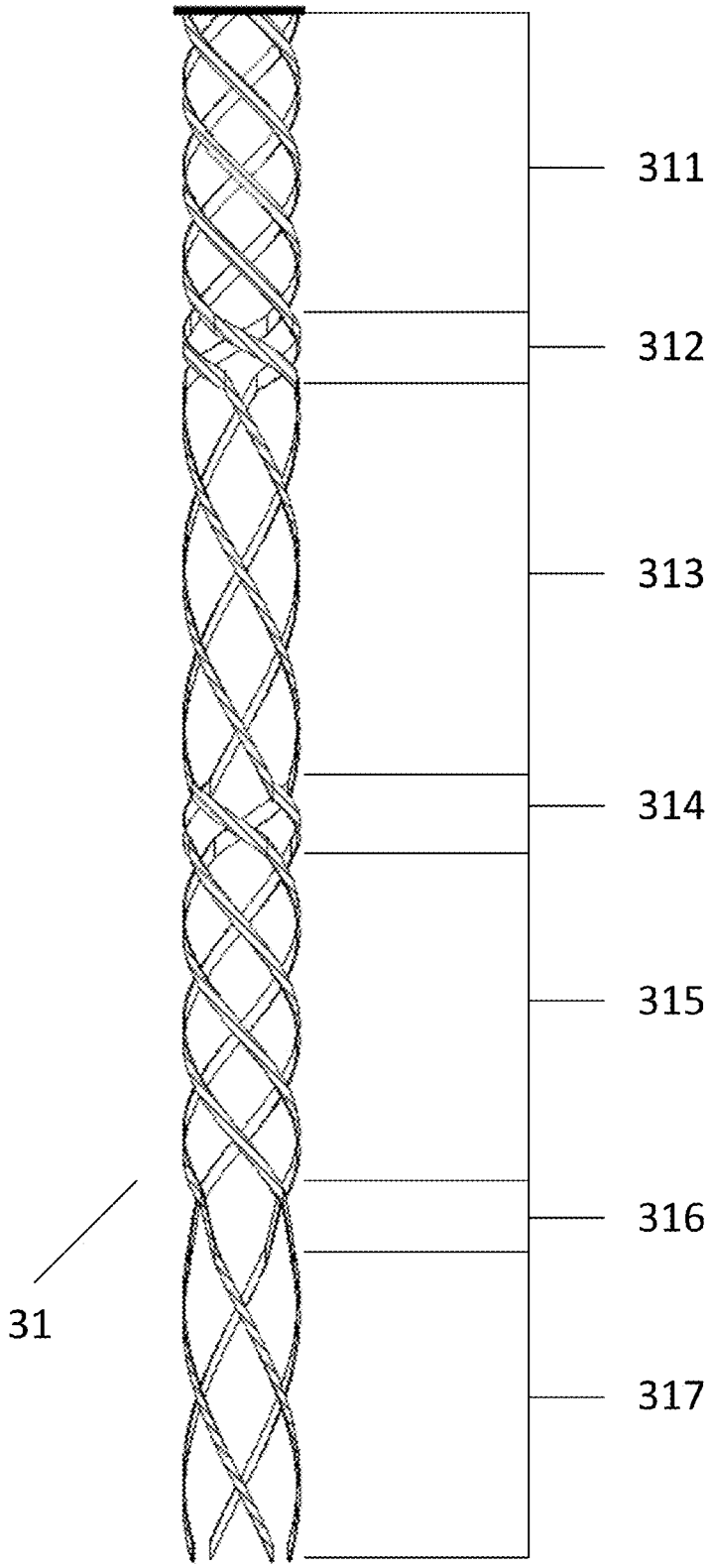
Figure 3B:
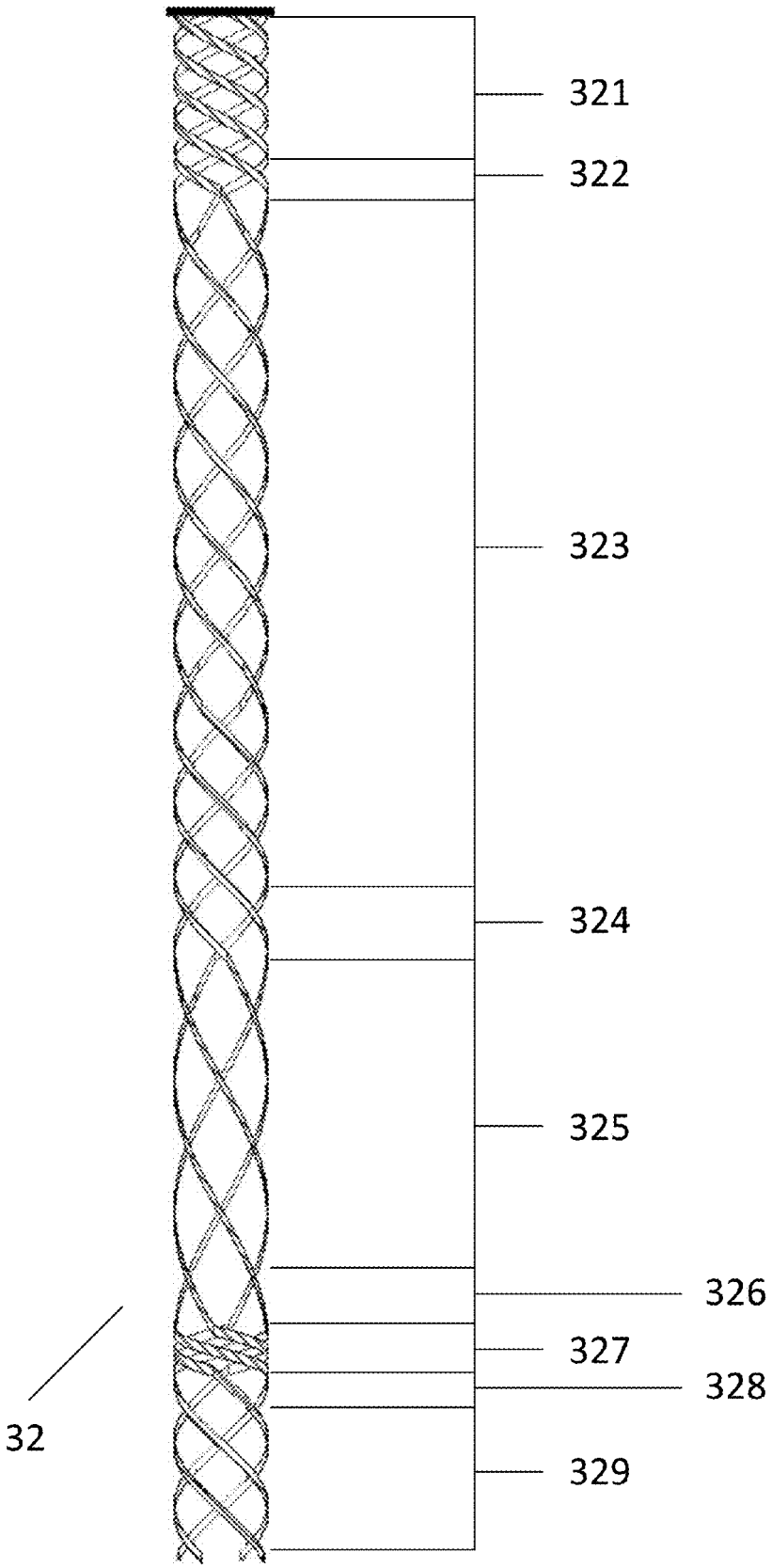
Figure 3C:
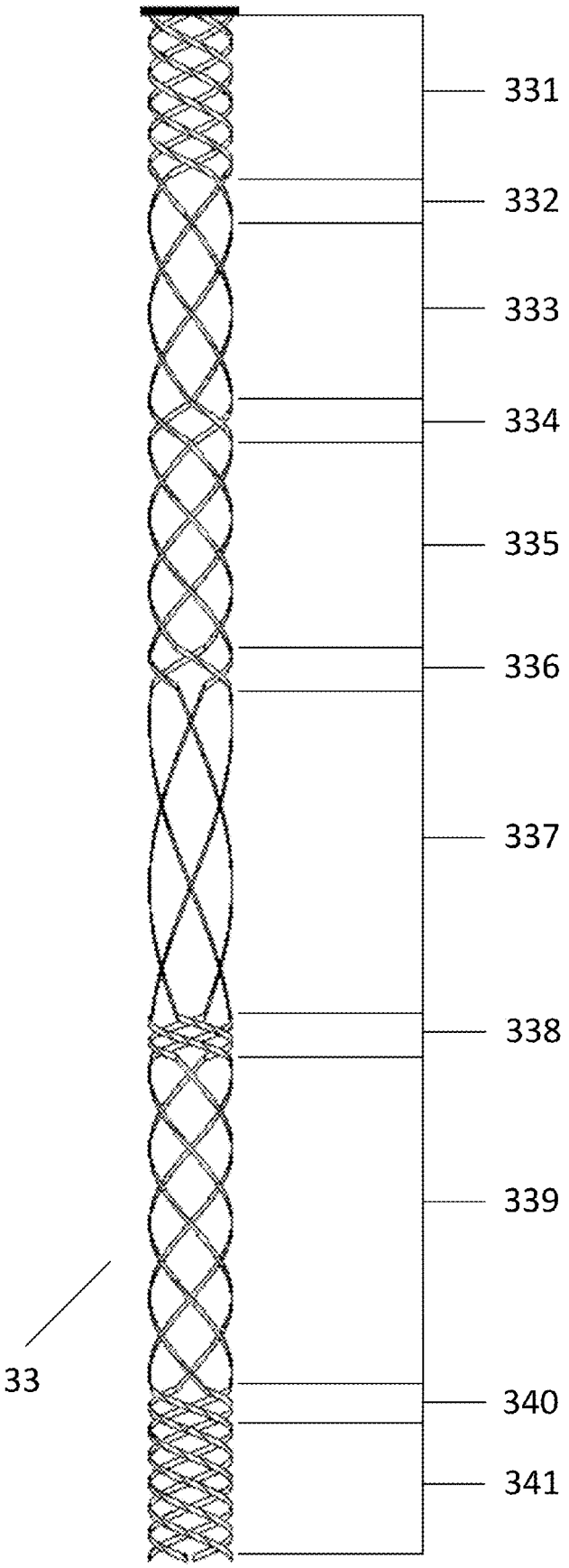
Figure 5A:
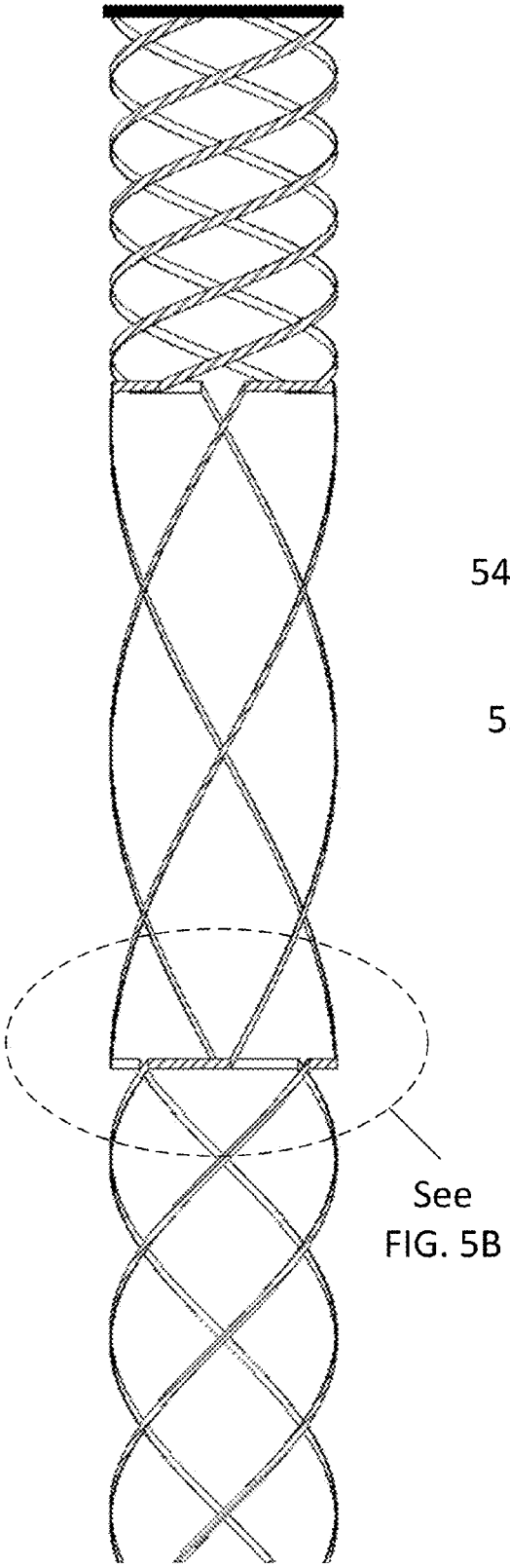
Figure 5B:
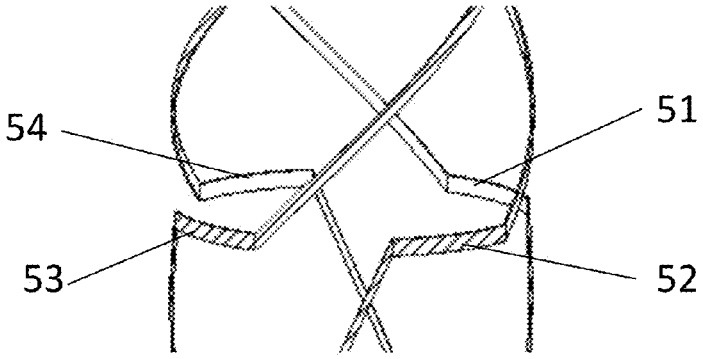
Figure 6A:
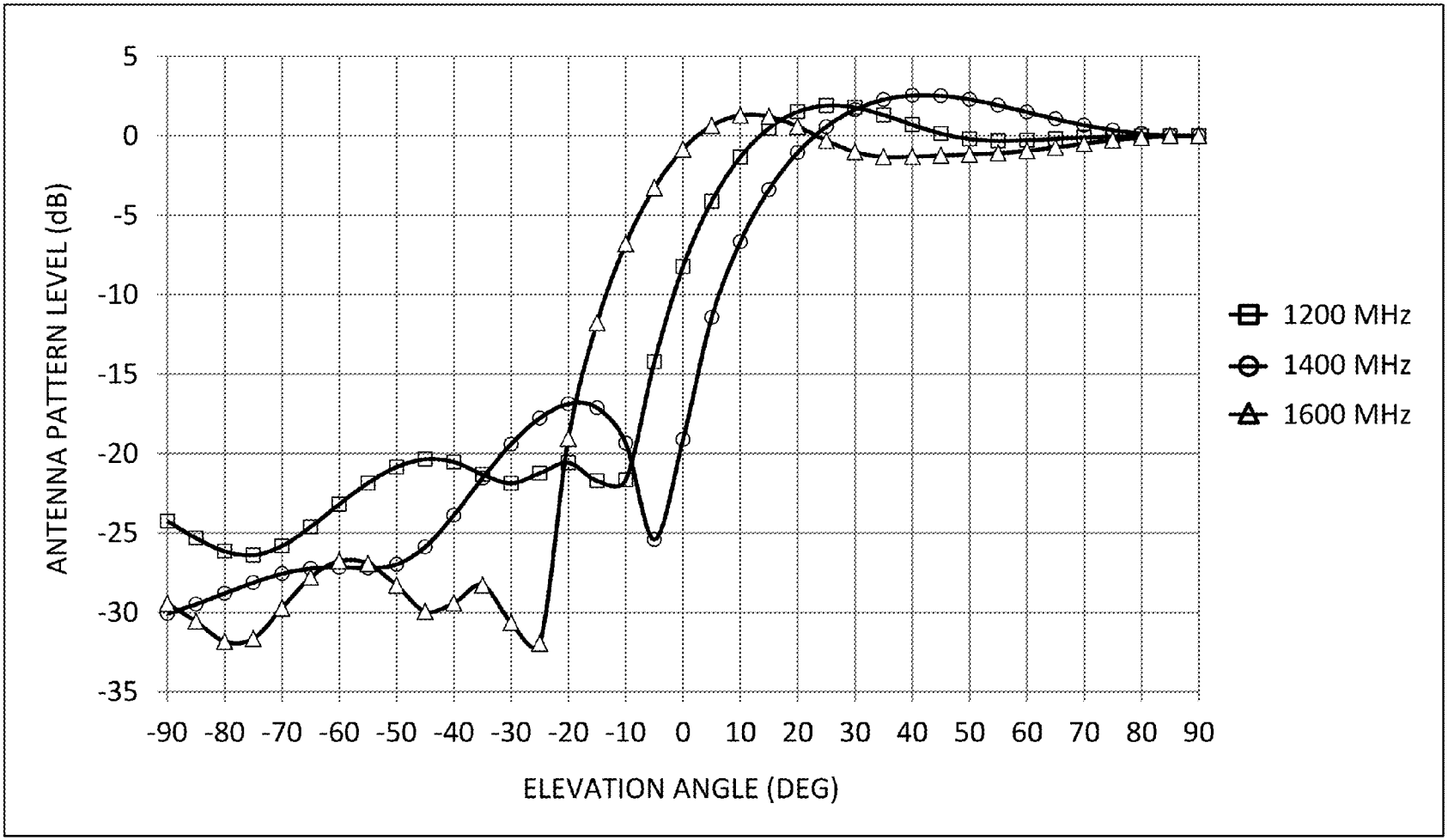
Figure 6B:
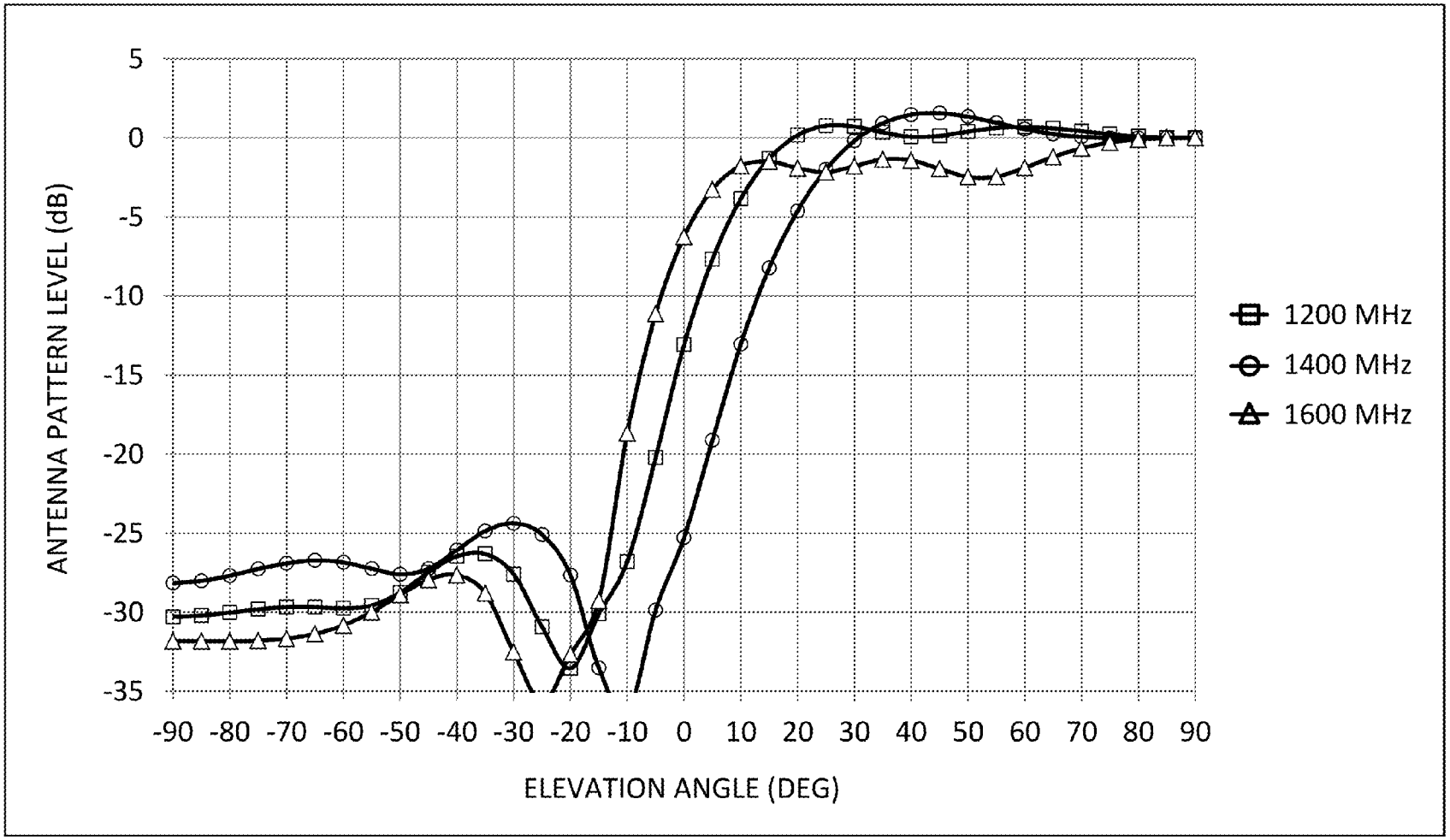
Figure 6C:
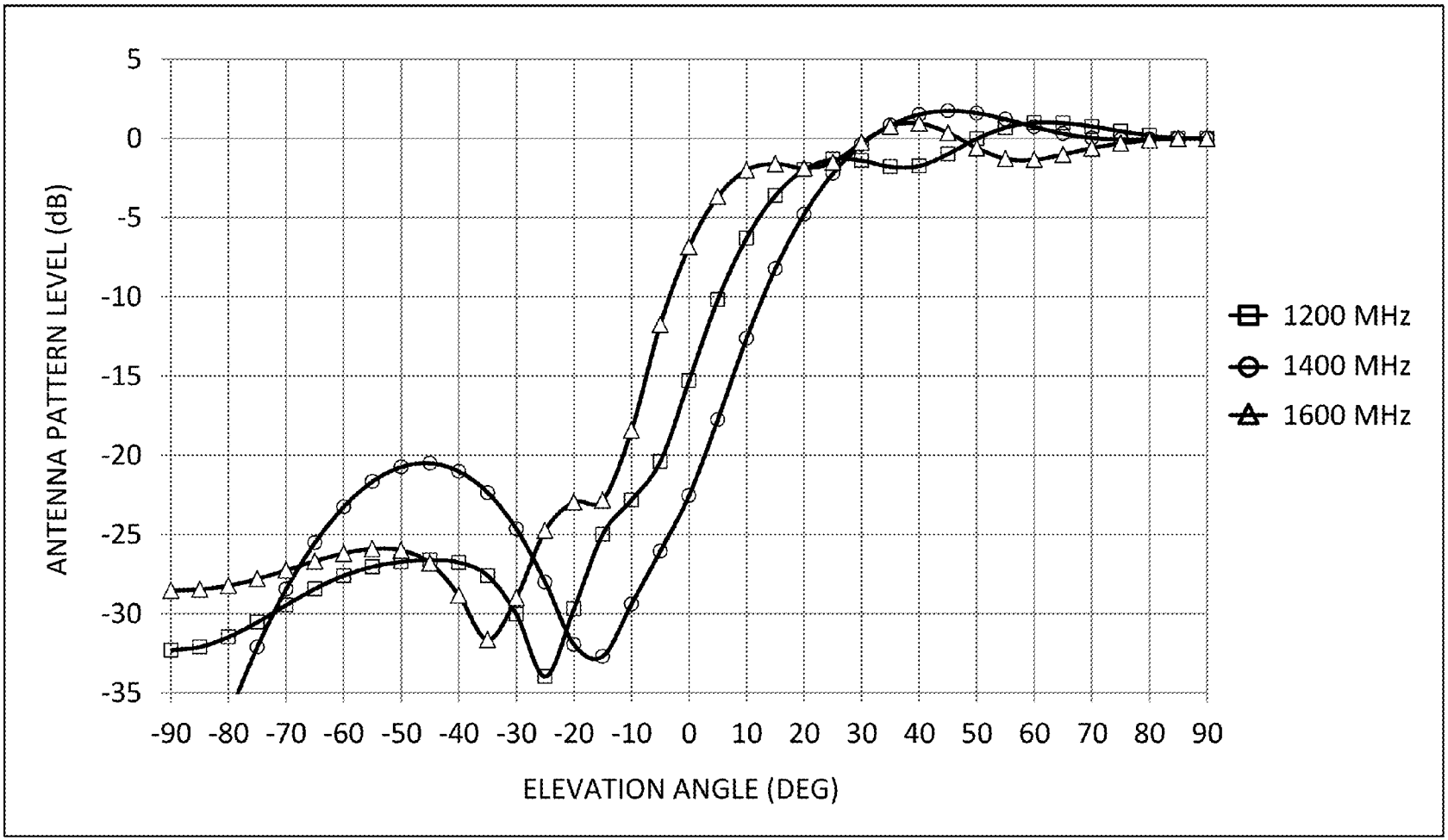
Figure 7:
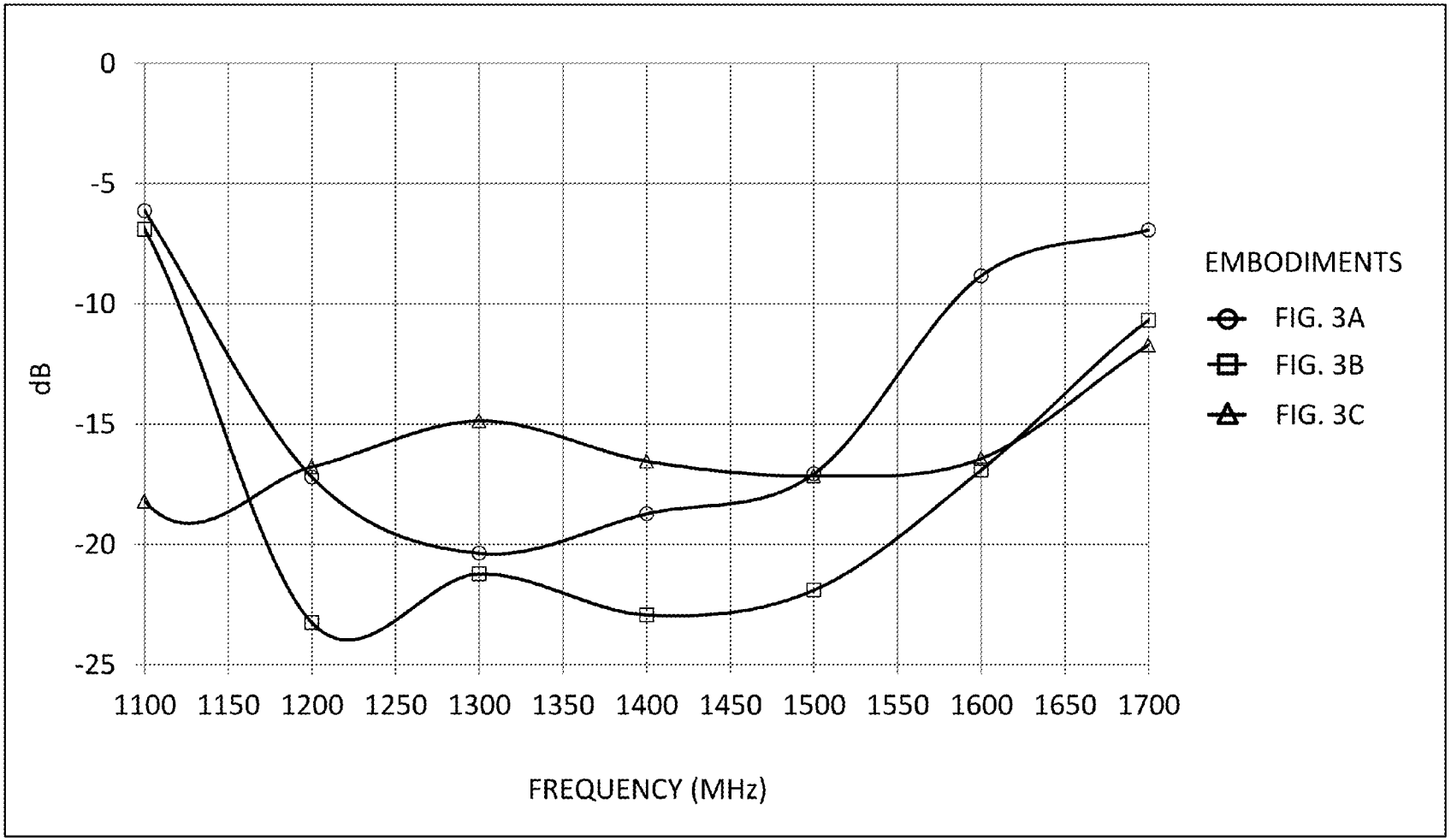

FIGS. 3A, 3B, 3C present embodiments of the design of a quadruple cylindrical spiral antenna;

FIG. 4 shows parameters for design embodiments of a quadruple cylindrical spiral antenna shown in FIG. 3A, 3B, 3C;

FIGS. 5A, 5B show one of embodiments for a quadruple cylindrical spiral antenna;

FIG. 6A depicts graphs of the antenna pattern for the design shown in FIG. 3A;

FIG. 6B presents graphs of the antenna pattern for the design shown in FIG. 3B;

FIG. 6C shows graphs of the antenna pattern for the design shown in FIG. 3C; and FIG. 7 shows graphs of the DU ratio for elevation θ=10° for embodiments shown in FIG. 3A, 3B, 3C.

DETAILED DESCRIPTION OF THE PREFERRED EMBODIMENTS

Reference will now be made in detail to the preferred embodiments of the present invention, examples of which are illustrated in the accompanying drawings.

Figure 1:
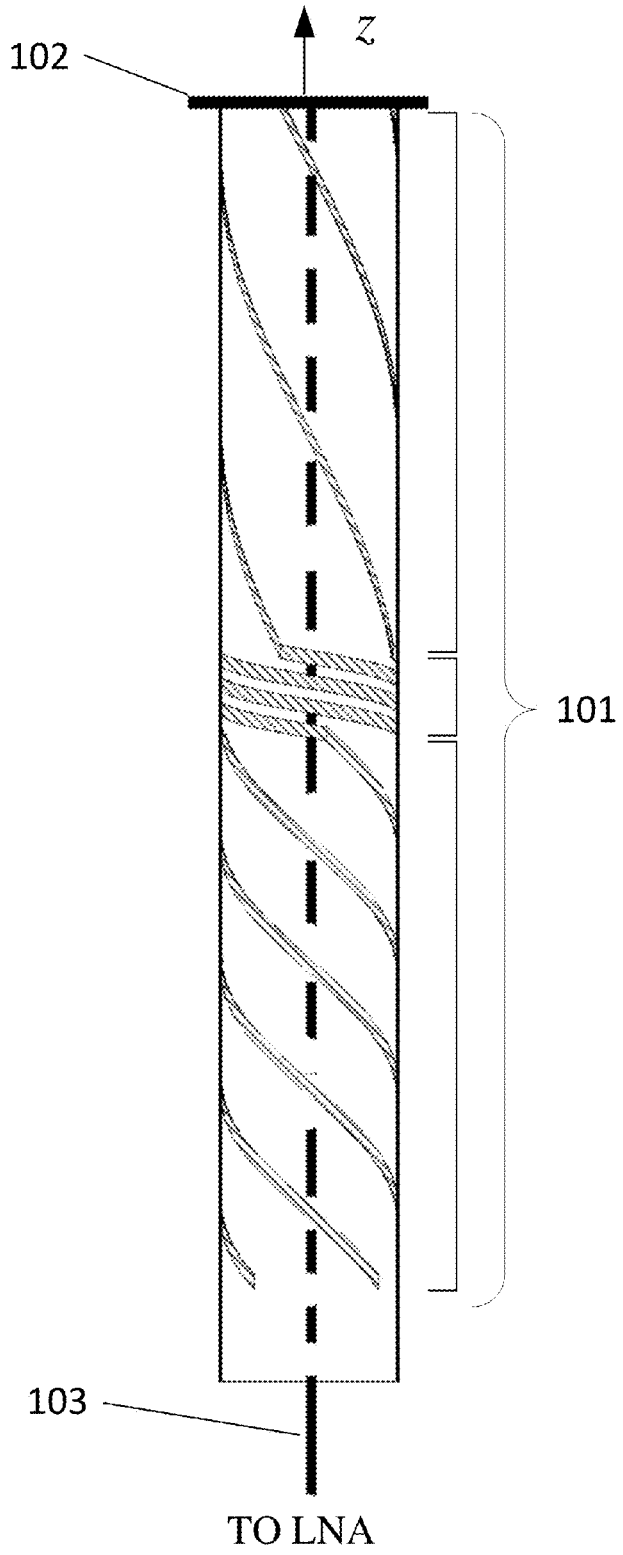
FIG. 1 shows an appearance of a quadruple cylindrical spiral antenna.

A wideband circularly-polarized antenna is proposed to receive GNSS signals. According to FIG. 1, the antenna comprises a set of quadruple spiral elements 101, an excitation circuit 102, and a power cable 103. The antenna design is elongated along the vertical axis (z). Positive direction of axis z corresponds to θ=90°.

The excitation circuit 102 is located above, and, thereby, the backfire operation mode is implemented. The power cable 103 is in the center of the antenna. The upper end of the power cable 103 is connected to the excitation circuit 102. The lower end of the power cable 103 is connected to the input of a low-noise amplifier (the LNA is not shown).

The excitation circuit is well-known and is an equal-amplitude power splitter with one input and four outputs. The phase difference between neighboring outputs is 90 degrees. Each output of the excitation circuit is connected to a corresponding conductor of the first (upper) quadruple spiral element, thereby providing excitation of a right hand circular polarization (RHCP) wave in the positive direction of the vertical antenna axis z. The antenna pattern has maximum in this direction.

Each of quadruple spiral elements consists of four conductors wound at the same angle and forming a quadruple spiral whose axis is aligned with the z axis. Each conductor is one spiral turn of the quadruple spiral. The winding angle for the conductors is the same for the entire quadruple spiral element.

Figure 2A:
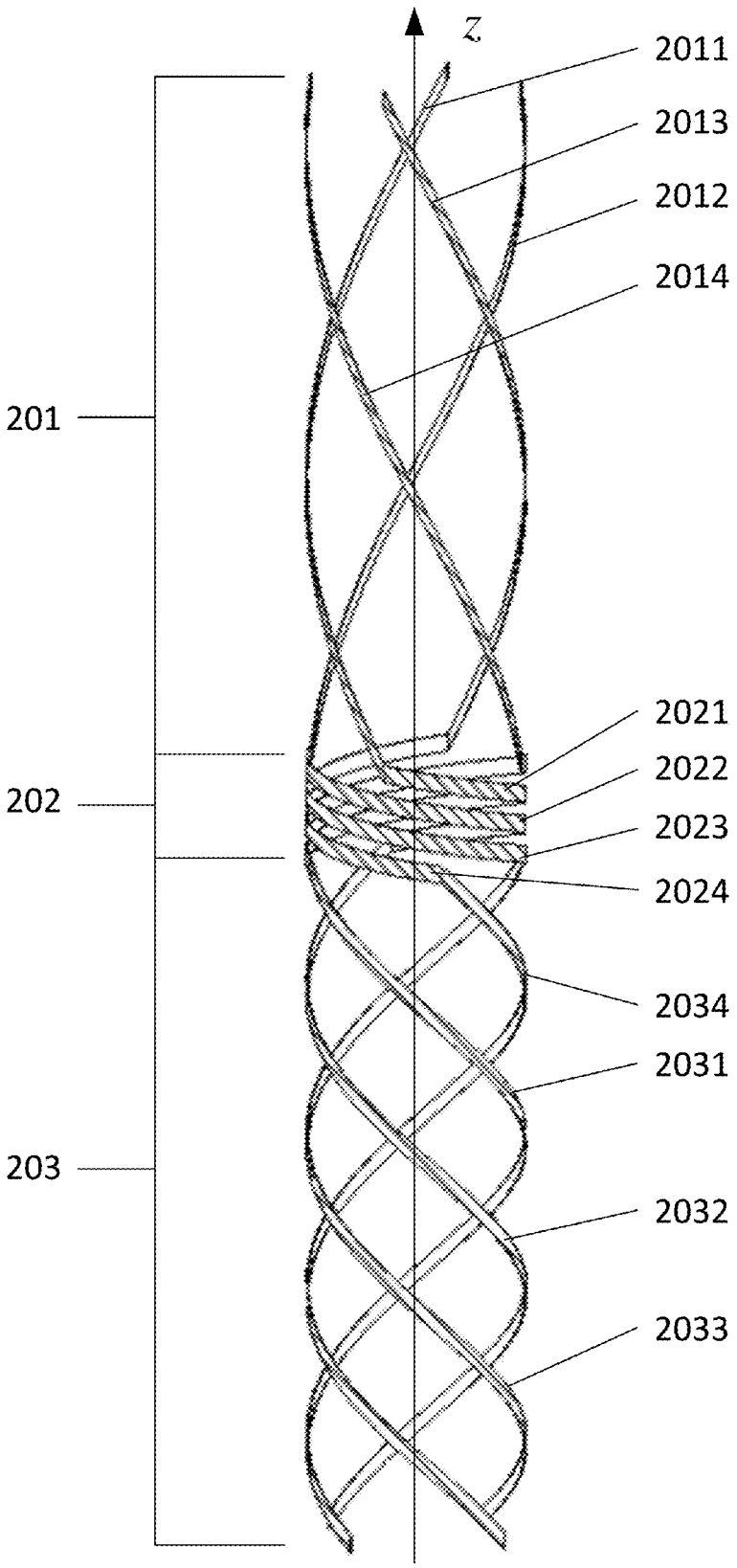
FIGS. 2A, 2B show quadruple cylindrical spiral elements.

FIG. 2A shows quadruple spiral elements 201, 202, 203, 204 and corresponding forming conductors: 2011, 2012, 2013, 2014; 2021, 2022, 2023, 2024, 2031, 2032, 2033, 2034. The conductors are applied to a dielectric substrate (not shown) that is further bent to form a hollow cylinder.

Figure 2B:
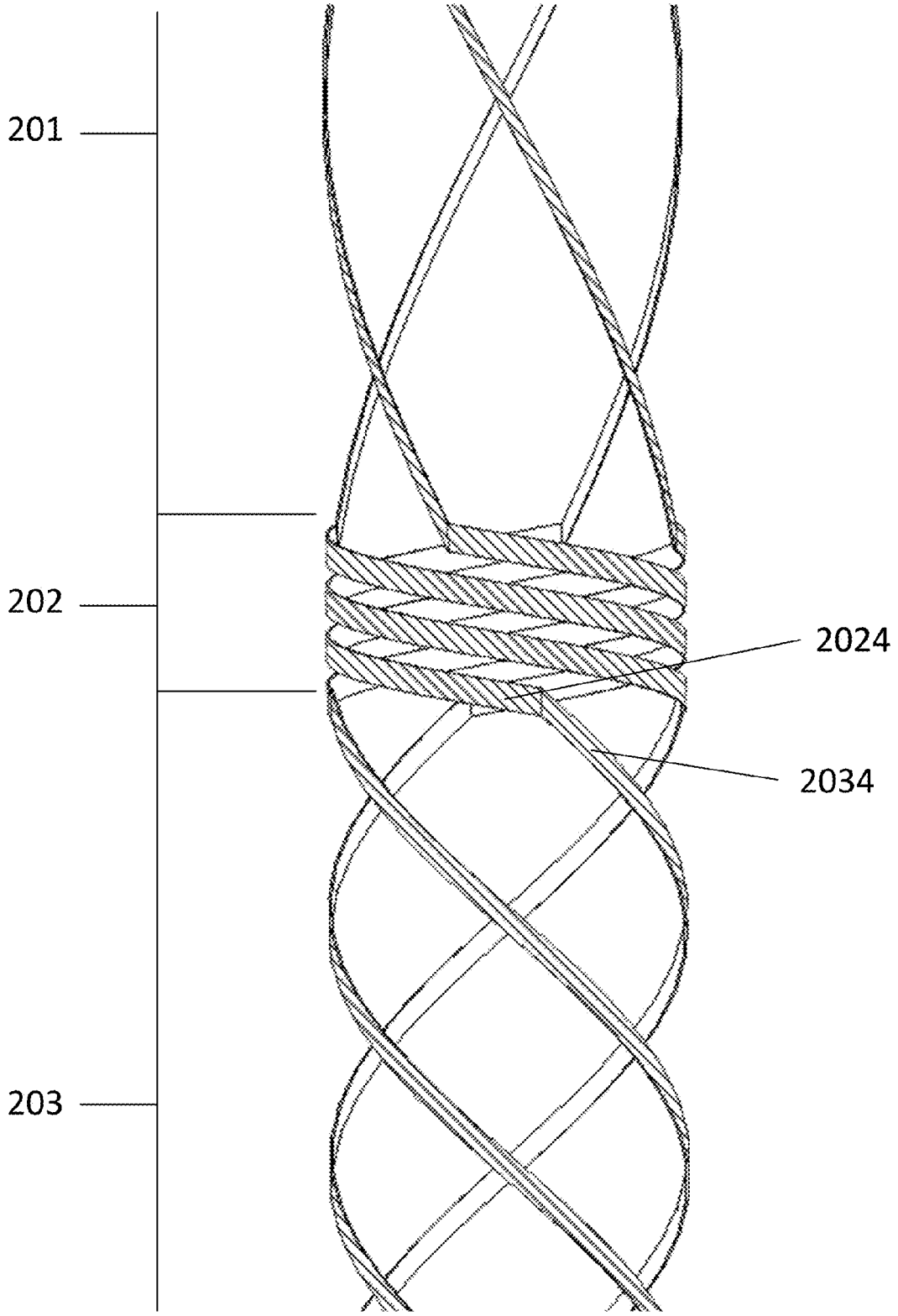

Each conductor has a first (top) and second (bottom) ends. From FIG. 2B, the first and second conductor ends (for example, 2024 and 2034) of neighboring spiral elements (for example, 202 and 203) geometrically match.

The exception of this rule is conductors of the first (top) and the last (bottom) elements. First (top) conductor ends of the first quadruple spiral element are connected to the excitation circuit, and second (bottom) conductor ends of the last quadruple spiral element are open.

Thus, the antenna includes a set of two or more quadruple spiral elements. A feature of the design is the same winding angle for the conductors of the same spiral elements, while the conductors of the neighboring spiral elements have different winding angles.

FIGS. 3A, 3B, 3C show possible embodiments of the spiral antenna. FIG. 3A presents a design of the spiral antenna with seven spiral elements, FIG. 3B shows a design with nine spiral elements, and the embodiment of FIG. 3C includes eleven spiral elements. In Table of FIG. 4 there are parameters of the embodiments shown. Note that although the described embodiments use 4 spiral conductors, more (e.g., 6 or 8) or fewer (e.g., 3) can also be used.

First and second conductor ends of the neighboring spiral elements can mismatch.

FIG. 5A, 5B show an embodiment with mismatching first and second conductor ends of the neighboring elements. In this case, the conductors of the neighboring spiral elements are connected to each other by conductors 51, 52, 53, 54 which are circle segments.

FIG. 6A, FIG. 6B, and FIG. 6C show graphs of antenna patterns normalized to the zenith (θ=90°) for different design embodiments. Parameters of these embodiments are given in FIG. 4. It can be seen that the antenna provides an AP with a nearly stable level in the upper hemisphere, a drop in the level close to the horizon, and a small level in the lower hemisphere.

FIG. 7 presents frequency graphs for DU ratio at θ=10°, that is $$DU(\theta) = \frac{F(-10°)}{F(10°)}$$

for different embodiments. Embodiments 2 and 3 are seen to provide a DU (θ=10°) ratio at least −15 dB in the whole frequency range from 1164-1610 MHz. Embodiment 1 produces the worst ratio DU (θ=10°) in the high-frequency part of the range, but the actual antenna has the smallest dimensions, of the three embodiments discussed herein.

Having thus described a preferred embodiment, it should be apparent to those skilled in the art that certain advantages of the described method and apparatus have been achieved.

It should also be appreciated that various modifications, adaptations, and alternative embodiments thereof may be made within the scope and spirit of the present invention. The invention is further defined by the following claims.

What is claimed is:

1. An antenna for receiving circularly polarized signals, the antenna comprising:

a hollow dielectric cylinder oriented along a vertical axis;

four spiral conducting elements wrapped around the cylinder;

the four spiral conducting elements divided into at least three longitudinal sections, wherein the conducting elements in each section have a constant winding angle around the cylinder, wherein the winding angle of all of the conducting elements in the same longitudinal section is the same, and wherein neighboring longitudinal sections have different winding angles relative to each other; and an excitation circuit connected to the conducting elements, wherein the antenna provides a down/up ratio $$DU(\theta) = \frac{F(-10°)}{F(10°)}$$

of at least −15 dB in a frequency range from 1164-1610 MHz, where F(−10°) is a gain of the antenna at −10° elevation, and F(10°) is a gain of the antenna at +10° elevation.

2. The antenna of claim 1, wherein an amplitude antenna pattern is symmetrical relative to the vertical axis and its maximum is in a positive direction of the vertical axis.

3. The antenna of claim 1, wherein the excitation circuit is above the cylinder.

4. The antenna of claim 1, wherein each conducting element of each longitudinal section is one spiral turn around the cylinder.

5. The antenna of claim 1, wherein each conducting element of at least one of the longitudinal sections is one spiral turn around the cylinder.

6. The antenna of claim 1, wherein each conducting element has first and second ends, and the first ends of the conducting elements of a top longitudinal section are connected to the excitation circuit, and the second conductor ends of the conducting elements of a bottom longitudinal section are open.

7. The antenna of claim 1, wherein each conducting element has first and second ends, and first and second conductor ends of neighboring quadruple spiral element are rotationally aligned on the cylinder so as to connect to each other.

8. The antenna of claim 1, wherein each conducting element has first and second ends, and first and second conductor ends of neighboring quadruple spiral element are rotationally mis-aligned on the cylinder, and are connected to each other with circular arc elements that are oriented transverse to the vertical axis.

9. The antenna of claim 1, further comprising a power cable connected to the excitation circuit and located inside the cylinder.

10. An antenna comprising:

a dielectric cylinder having a longitudinal axis;

four spiral conductors wrapped around the cylinder;

the four spiral conductors divided into at least three longitudinal sections, wherein the conductors in each section have a constant winding angle around the cylinder, wherein the winding angle of all of the conductors in the same longitudinal section is the same, and wherein neighboring longitudinal sections have different winding angles relative to each other; and an excitation circuit connected to the conductors, wherein the antenna provides a down/up ratio $$DU(\theta) = \frac{F(-10°)}{F(10°)}$$

at least −15 dB, where F(−10°) is a gain of the antenna at −10° elevation, and F(10°) is a gain of the antenna at +10° elevation.

11. An antenna comprising:

a dielectric cylinder having a longitudinal axis;

at least three spiral conductors wrapped around the cylinder;

the at least three spiral conductors divided into top and bottom longitudinal sections, wherein the spiral conductors in each section have a constant winding angle around the cylinder, wherein a winding angle of all of the conductors in the same longitudinal section is the same, and wherein a winding angle of the top longitudinal section is different from a winding angle of the bottom longitudinal section;

a central conducting portion connecting the top and bottom longitudinal sections, wherein conductors in the central conducting portion are arranged circularly around the dielectric cylinder; and an excitation circuit connected to the conductors, wherein the antenna provides a down/up ratio $$DU(\theta) = \frac{F(-10°)}{F(10°)}$$

of at least −15 dB, where F(−10°) is a gain of the antenna at −10° elevation, and F(10°) is a gain of the antenna at +10° elevation.

* * * * *